United States Patent [19]

Piguet et al.

[11] Patent Number: 4,588,305

[45] Date of Patent: May 13, 1986

[54] ELECTRONIC CHRONOGRAPH WATCH HAVING ANALOG AND DIGITAL DISPLAY OF MEASURED TIME PERIODS

[75] Inventors: Albert Piguet, Le Solliat; Jean-Daniel Dubois, L'Orient, both of Switzerland

[73] Assignee: Nouvelle Lemania S.A., L'Orient, Switzerland

[21] Appl. No.: 688,275

[22] Filed: Jan. 2, 1985

Related U.S. Application Data

[63] Continuation of Ser. No. 449,227, Dec. 13, 1982, abandoned.

[30] Foreign Application Priority Data

Dec. 28, 1981 [CH] Switzerland ..... 8313/81

[51] Int. Cl.[4] ..... G04B 17/12

[52] U.S. Cl. ..... 368/185; 368/106; 368/112

[58] Field of Search ..... 368/70, 71, 76, 79, 368/82–84, 107, 110, 113, 62, 223, 239, 242, 106, 185, 112

[56] References Cited

U.S. PATENT DOCUMENTS

| | | | |
|---|---|---|---|
| 3,884,035 | 5/1975 | Jeannet et al. | 58/74 |
| 3,890,779 | 6/1975 | Capt et al. | 368/106 |
| 3,910,362 | 10/1975 | Piguet | 368/106 |
| 3,927,519 | 12/1975 | Berthoud | 368/106 |
| 4,212,158 | 7/1980 | Tamaru | 368/80 |
| 4,250,572 | 2/1981 | Yoshida | 368/242 |
| 4,257,115 | 3/1981 | Hatuse et al. | 368/82 |
| 4,259,735 | 3/1981 | Vuille | 368/185 |
| 4,270,197 | 5/1981 | Minowa | 368/113 |
| 4,392,216 | 7/1983 | Tsuji | 368/204 |
| 4,396,294 | 8/1983 | Yoshida | 368/71 |
| 4,415,272 | 11/1983 | Heinzelmann | 368/185 |

FOREIGN PATENT DOCUMENTS

| | | |
|---|---|---|
| 2028545 | 3/1980 | United Kingdom . |
| 2067798 | 7/1981 | United Kingdom . |

*Primary Examiner*—Bernard Roskoski
*Attorney, Agent, or Firm*—Parkhurst & Oliff

[57] ABSTRACT

A motor actuates a wheel train which drives center hour and minute hands as in an ordinary analog-display watch. Another motor actuates a chronograph train which drives a chronograph sweep seconds-hand, a minute-register hand, and an hour-register hand offset toward 6 o'clock. A lever actuates a column wheel which starts and stops the second motor by means of a control lever integral with a stem. A hammer resets the chronograph gears. An electronic circuit comprises a liquid-crystal display element which displays the hundredths of a second when the chronograph is running or the date when the chronograph is not running.

10 Claims, 9 Drawing Figures

9
32k
D.T.
Dec
8
16
Pi
P
CK
CM
7. 7/10
18
12
11
7
1Hz
100 Hz
3b
10
3a
3a'
5
7
C
7
10
6
P
R
CK
13
6
1Hz
14
15
CM
2
R
CK
1024 Hz
D
32 KHz
Osc
Q
T
HS
Push Buttons
Crown
7
10
6
18

ELECTRONIC CHRONOGRAPH WATCH HAVING ANALOG AND DIGITAL DISPLAY OF MEASURED TIME PERIODS

This is a continuation of application Ser. No. 449,227 filed Dec. 13, 1982, now abondoned.

BACKGROUND AND SUMMARY OF THE INVENTION

This invention relates to electronic timepieces, and more particularly to an electronic chronograph watch of the type provided with a quartz time standard, a watch motor actuating step-wise a time-period counting device comprising a central seconds-counter, and a push-button control mechanism for starting, stopping, and resetting the counting device, this mechanism controlling a pulse counter connected to the time standard, the input signal of which pulse counter is at a frequency higher than 1 c/s, and the output signal of which pulse counter controls the chronograph motor at a frequency lower that 10 c/s.

Mechanically driven chronograph watches generally comprise a sweep seconds-hand which, when the chronograph is running, is coupled to the wheel train and consequently advances step by step at the frequency given by the hair-spring-balance system, i.e., usually at a frequency of 18,000 vibrations per hour. When this hand moves over a dial on the order of 25–30 mm. in diameter, the step-by-step movement of its tip along the hour-circle is easy to read, so that a period of time measured by the chronograph device can be read with an accuracy of one-fifth of a second by means of this hand. When the hairspring-balance system has a frequency of 36,000 vibrations per hour, a measured period of time can even be read with an accuracy of one-tenth of a second by means of the chronograph seconds-hand.

Attempts have already been made to produce electronic-type chronograph watches, but until now no satisfactory solution has been thought of as concerns a sensible presentation of the data counted and displayed by the chronograph mechanism.

U.S. Pat. No. 3,884,035 teaches that in designing an electronic chronograph watch having a quartz time standard with a frequency divider which supplies signals at a frequency suitable for driving a stepping motor actuating a time-display wheel train, it is advisable to provide an intermediate output in the frequency divider in order to have an intermediate signal at a frequency which is at least on the order of 10 c/s and to divide this intermediate signal separately into a frequency, conveniently 1 c/s, to actuate a stepping motor driving a display mechanism comprising a chronograph seconds-hand and, as the case may be, a minute-counter and an hour-counter. As a matter of fact, the use of a stepping motor actuated at a frequency of 1 c/s is compatible with the service life of batteries suitable for being accommodated in the case of a chronograph watch intended to be worn as a wrist watch, and two motors of this kind can be driven by a power source of appropriate capacity. With such a design, however, the periods of time measured by the chronograph device cannot be ascertained with greater accuracy than one second.

To remedy this drawback, the above-mentioned U.S. patent likewise provides for an intermediate output from the auxiliary frequency divider and the driving of a third motor at a frequency which may be higher than 1 c/s.

In this case, the display device of the chronograph will include a seconds-hand jumping step-wise at the rhythm of 1 c/s, plus a hand indicating fractions of a second. However, the complexity of such a system is a serious obstacle to its commercial production.

The chronograph watch described in U.K. Published Application No. 2,028,545, on the other hand, uses only two stepping motors, one actuating the wheel train indicating the time of day, the other actuating the chronograph train. In this case, in order that periods of time may be read with greater accuracy than one second, the chronograph motor is driven by pulses which leave the counting circuit at a frequency of 10 c/s. On the other hand, the sweep seconds-hand forming part of the chronograph display mechanism is driven at a speed of rotation ten times the normal speed, so that it accomplishes one revolution over the dial in six seconds. It is thus possible to read tenths of a second, but the reduction ratios which must be provided for in the chronograph train for driving a minute-counter and an hour-counter are then such that the chronograph watch movement becomes excessively bulky. On the other hand, periods of less than one minute but more than six seconds are much less easy to read than with a conventional display.

More recently (see U.K. Published Application No. 2,067,798), another solution has been proposed to remedy the difficulties thus encountered: the chronograph motor is driven at a frequency of 1 c/s and actuates a sweep seconds-hand which jumps through an angle of 6 degrees at each step of the motor, while the motor driving the device displaying the time of day is driven normally at a frequency of one-sixth c/s, or one step every six seconds, and actuates a small offset seconds-hand effecting one revolution per minute at the rate of ten jumps per minute. Moreover, the intermediate counter which controls the chronograph motor is associated with a memory and connected to the time-of-day display motor, so that when the chronograph motor is blocked after a period of time has been measured, the contents of the intermediate counter are compared with the position of the small seconds-hand, and the time-of-day display motor receives a number of pulse such that the position of the small seconds-hand indicates the tenths of seconds of the period of time which has just been measured.

This solution solves the difficulties of bulkiness and of supplying power to the control circuit of the chronograph watch, but it remains complicated to read the period of time measured. In addition, if a reading has to be made at a glance, i.e., just as the counters are being reset so that counting can continue immediately, this solution excludes the possibility of reading fractions of a second.

It is therefore an object of this invention to provide a chronograph watch in which the various functions desired are presented and displayed under the most sensible possible conditions in order to enable clear, easy, and accurate reading of the data supplied.

A further object of this invention is to remedy the drawbacks described above by providing an electronic-type chronograph watch wherein the chronograph device comprises a sweep seconds-hand, and the fractions of a second can be displayed and read easily and accurately.

To this end, in the electronic chronograph watch according to the present invention, of the type initially mentioned, the counter further transmits at least one intermediate signal at a frequency intermediate between those of the input and output signals, and the intermediate signal or signals control an electro-optical display device indicating the fractions of a second while the chronograph is running.

BRIEF DESCRIPTION OF THE DRAWINGS

A preferred embodiment of the invention will now be described in detail with reference to the accompanying drawings, in which.

DETAILED DESCRIPTION OF THE PREFERRED EMBODIMENTS

Figure 1:
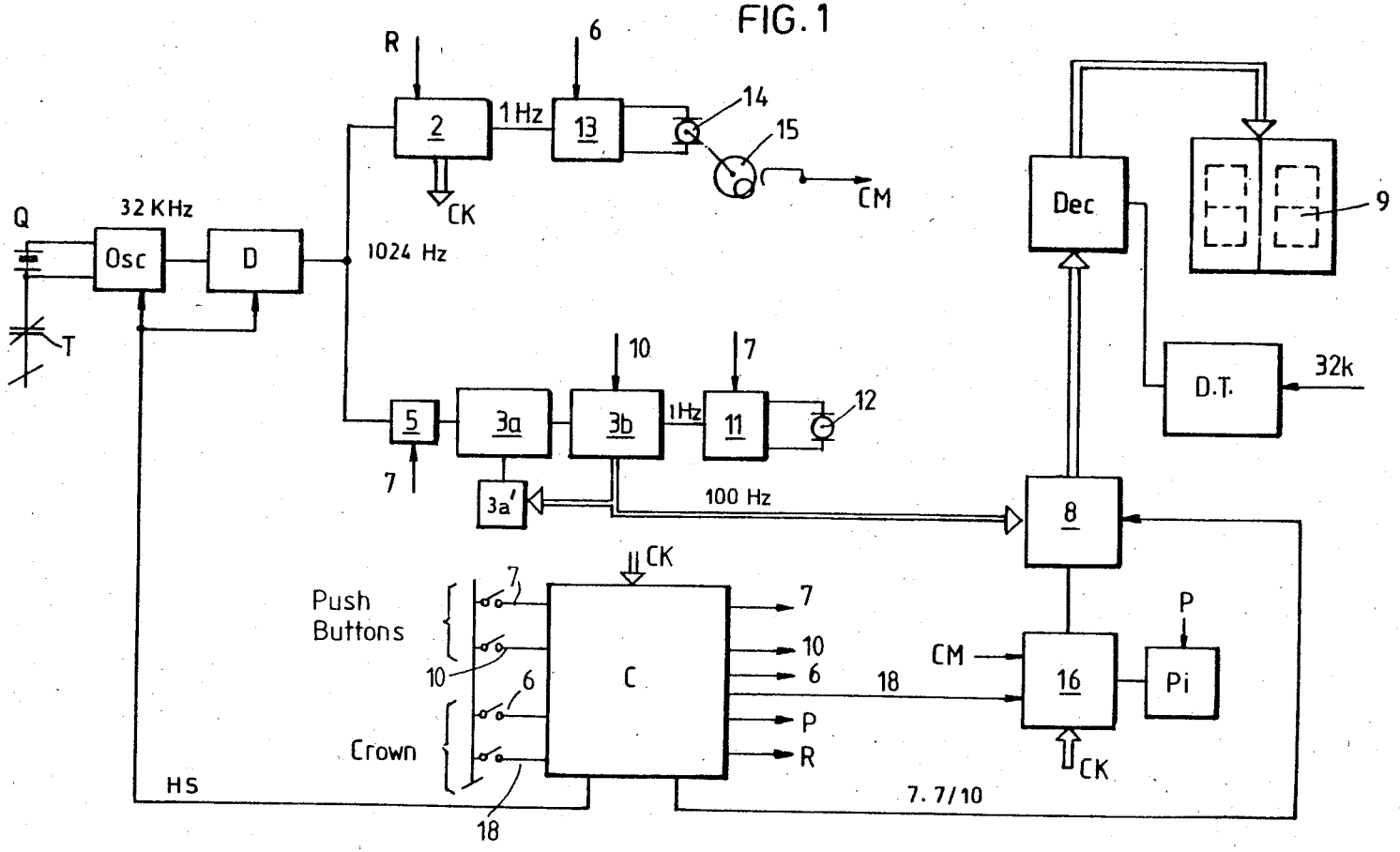
FIG. 1 is a block diagram of the electronic circuit of the module of the watch.

The block diagram of FIG. 1 illustrates the general concept of the chronograph. A time standard 1 comprises a quartz crystal Q, an oscillating circuit Osc, and a frequency division first stage D. It supplies pulses at a frequency of 32.768 kc/s, for example, this frequency being adjustable by means of a trimmer T. In first divider stage D, the frequency of the time standard is reduced to 1,024 c/s. These signals are transmitted in parallel to two divider chains. Firstly, they are supplied to a frequency divider 2, the output signal of which is at a frequency of 1 c/s and is transmitted to a shaping circuit 13 which controls the drive of a watch motor 14. This is a stepping motor, rotating one step per second, which drives a wheel train including a 24-hour wheel 15 provided with a contact which closes once every 24 hours at midnight in order to produce pulses CM.

The 1,024 c/s pulses are also transmitted to a divider 3 preceding a switch circuit 5. Divider 3 is composed of an inhibitor element 3*a*, controlled by an inhibition control 3*a'* and having its output at a frequency of 1,000 c/s, and of a divider circuit proper 3b having three stages of division by ten, the output of which constitues a signal at a frequency of 1 c/s. This output signal is supplied to a shaping circuit 11 which controls a chronograph motor 12. An intermediate output of divider 3 supplies signals at a frequency of 100 c/s which are transmitted to a switching circuit 8 so that when the chronograph is started, these signals are then transmitted to the decoder Dec which controls a liquid-crystal digital display device 9 made up of two cells, each displaying the digits from zero to nine by means of a seven-segment display.

An output CK of divider 2 conveys signals of different frequencies obtained by successive divisions by two starting from the input signal at 1,024 c/s in order to effect the control of the various functions. These signals are transmitted especially to a control circuit C which comprises input terminals 7, 10, 6 and 18, each connected to a contact element which can be grounded by operating push buttons or a crown fixed to the end of a control stem disposed radially in the movement. The signal produced by the grounding or disconnection of contact element 7 brings about the opening and closing of switch 5 for starting and stopping chronograph motor 12. The signal produced at contact element 10 causes the resetting of divider 3 (1000:1). The signal produced at contact 6 is used to block control circuit 13 and, consequently, to stop watch motor 14. At the same time, a signal R resets frequency divider 2. Finally, the signal produced at contact 18 causes the emission of signals at a frequency of 1 second which appear after a 2-second wait and which are conveyed to a circuit 16, which is a date counter. As will be seen, signals CM produced by 24-hour wheel 15 are likewise transmitted to date counter 16 which, when the chronograph is not running, supplies decoder Dec and controls the display of the date on digital display device 9. The switchover to decoder Dec of the signals coming from the intermediate output of divider 3 or from date counter 16 which, when the chronograph is not running, supplies decoder Dec and controls the display of the date on digital display device 9. The switchover to decoder Dec of the signals coming from the intermediate output of divider 3 or from date counter 16 takes place in response to signals emitted under the effect of the input signals obtained at contacts 7 and 10.

Figure 2:
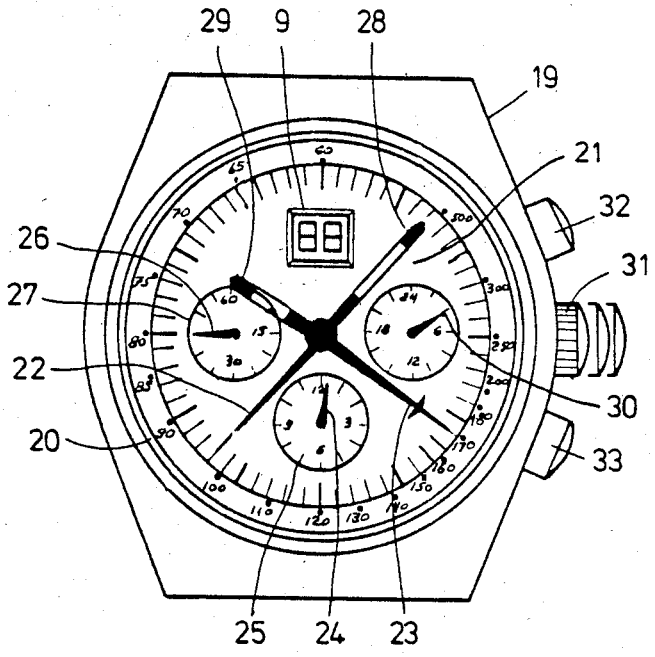
FIG. 2 is a top plan view of the embodiment to be described

FIG. 2 gives an overall view of the chronograph watch. A case 19 contains all of the mechanisms and circuits to be described below. It is the size of a wrist watch. Under a glass 20 there is a dial 21, above which three chronograph hands and four watch hands move. The chronograph hands are a large sweep seconds-hand 22, a minute-register hand 23, also disposed at the center of dial 21, and an hour-register hand 24 which is offset toward 6 o'clock and which rotates above a small hour-circle 25, effecting one revolution every 12 hours.

The watch hands comprise a small seconds-hand offset toward 9 o'clock and rotating above an hour-ring 27 graduated into 60 seconds, a minute-hand 28, an hour-hand 29—the two latter hands being conventional ones disposed at the center of dial 21—and an hour-register hand 30 for recording up to 24 hours which is offset toward 3 o'clock relative to the center and which rotates above an hour-circle divided into 24 hours. Offset toward 12 o'clock is the two-place digital display element 9 which is visible in a window of dial 21 and normally displays the date.

Like a conventional chronograph watch, case 19 bears on the 3 o'clock side a control stem having a crown 31, a chronograph starting and stopping push button 32, and a resetting push button 33. The present embodiment can be produced in two versions: in the first version, push button 33 is locked while the chronograph is running, whereas in the second version, button 33 is not locked, so that it is possible to take a reading at a glance while resetting the chronograph, i.e., without stopping it. This possibility of resetting and immediate continuation of counting without any intervening cessation is particularly useful for airline pilots during landing operations.

In other modifications (not shown in the drawing) the counting of hundredths of a second, in the chronograph function, might be provided for in such a way that if the reset button were pressed before the stop button, hence while the chronograph is running, the display of the hundredths of a second would be blocked for a moment and would then catch up with its normal count again. This would make it possible to read an intermediate time on the digital display.

Figure 3:
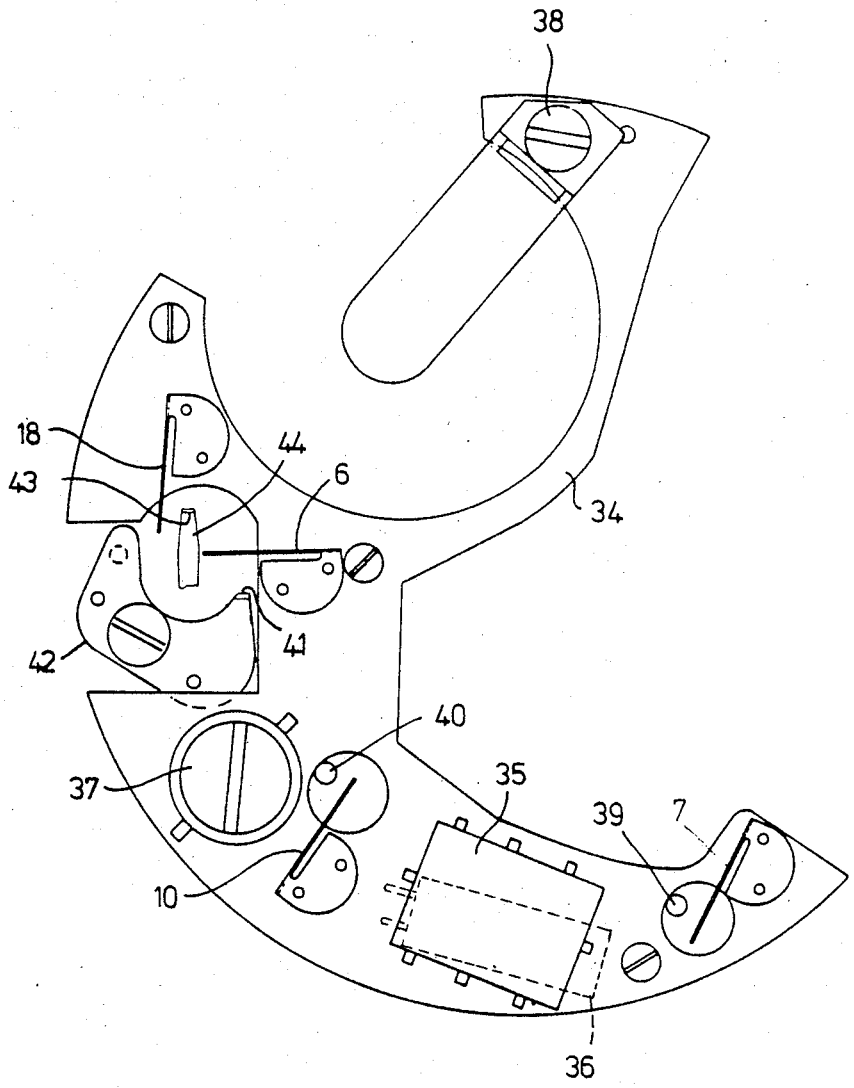
FIG. 3 is an inverted plan view showing the circuit board.

The movement of the chronograph watch being described comprises a circuit board 34 which may be seen in FIG. 3. This circuit board is seated in the movement of the watch. It is connected to another printed circuit element borne by the plate and placed under electro-optical display cell 9. Circuit board 34 bears all the electronic elements of the movement. Its main member is an IC chip 35 which is fixed on one of its faces and has various output terminals connected to the conductor pattern printed on the substrate.

Circuit board 34 bears a quartz crystal 36, disposed on the opposite face from circuit 35, an adjusting trimmer 37 next to circuit 35, a battery clip 38, and the four contact elements 6,7, 10 and 18. Each of these elements is made up of a small blanked and bent gold plate, part of which is soldered to board 34, while the other part forms a rectilinear tongue which extends free so that a movable element connected to ground can come in contact with it upon certain manipulations of the control mechanism, as will be seen below. These movable elements are a stem 39 parallel to the axis of the watch for contact 7, a stem 40 similar to stem 39 for contact 10, a nose 41 of a setting-lever 42 for contact 6, and a nose 43 of a yoke 44 for contact 18.

Figure 4:
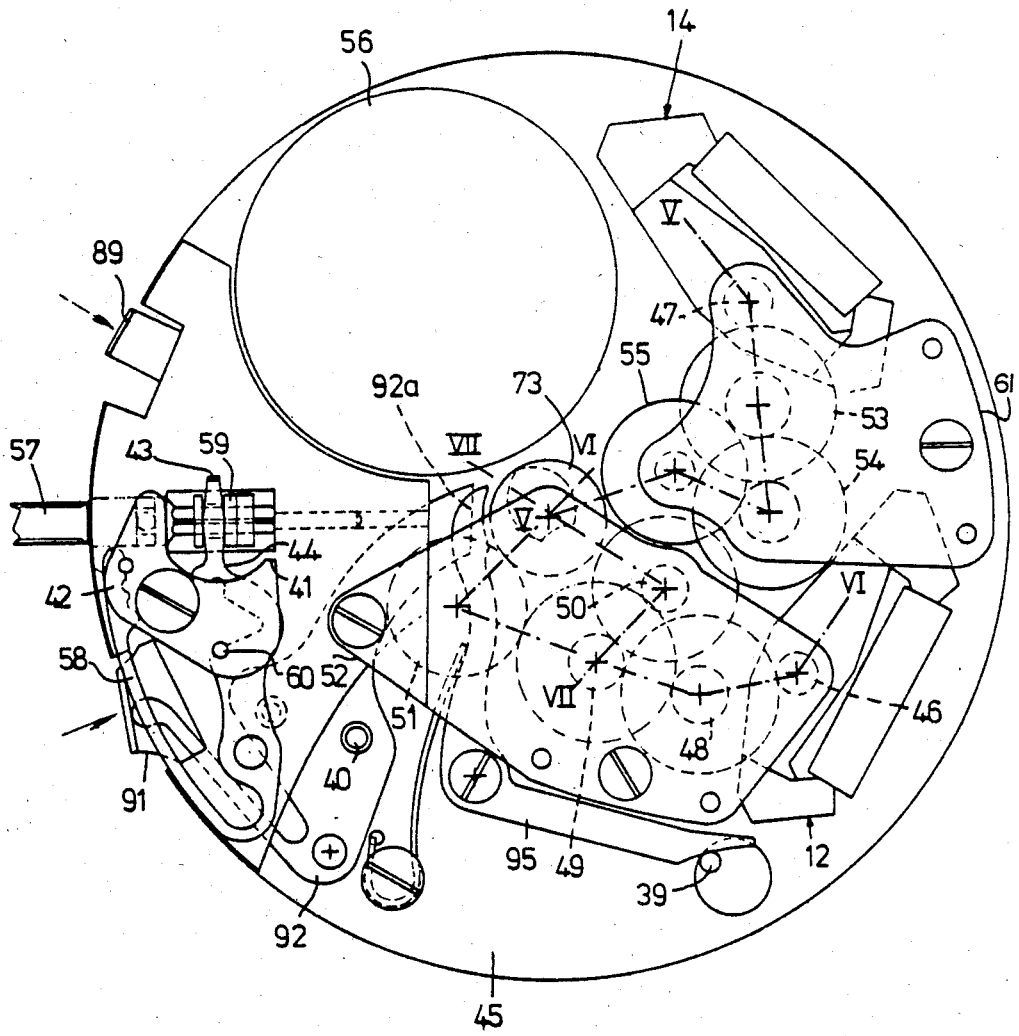
FIG. 4 is an inverted plan view of the chronograph watch movement, showing the gears depicted diagrammatically.

Elements 39, 40, 41, and 42 may likewise be seen in FIG. 4, which shows the general arrangement of the lower part of the movement, i.e., the part remote from the dial. It is in this part of the movement that stepping motors 12 and 14 and the wheel trains driving the various hands are to be found. All these elements are mounted on a round plate 45 which bears particularly the two motors 12 and 14. These stepping motors need not be described in detail, being of a type known and well-tried in the manufacture of analog-display watches. A sturdily constructed motor should be used, having sufficient torque to actuate the wheel trains described, e.g., a motor whose rotor rotates 180 degrees per second. As stated above, the rotor 46 of the first stepping motor 12 drives the chronograph train. This comprises first of all a chain of three reduction gears 48,49, and 51, the last of which is an intermediate wheel engaging a chronograph fourth wheel 73. In addition, a gear 50 meshing with the wheel of gear 49 drives the chronograph center wheel 76 (FIG. 7). All the gears of this train are supported by a chronograph bridge 52 fixed under plate 45, as will also be seen in FIGS. 6,7, and 8.

Figure 5:
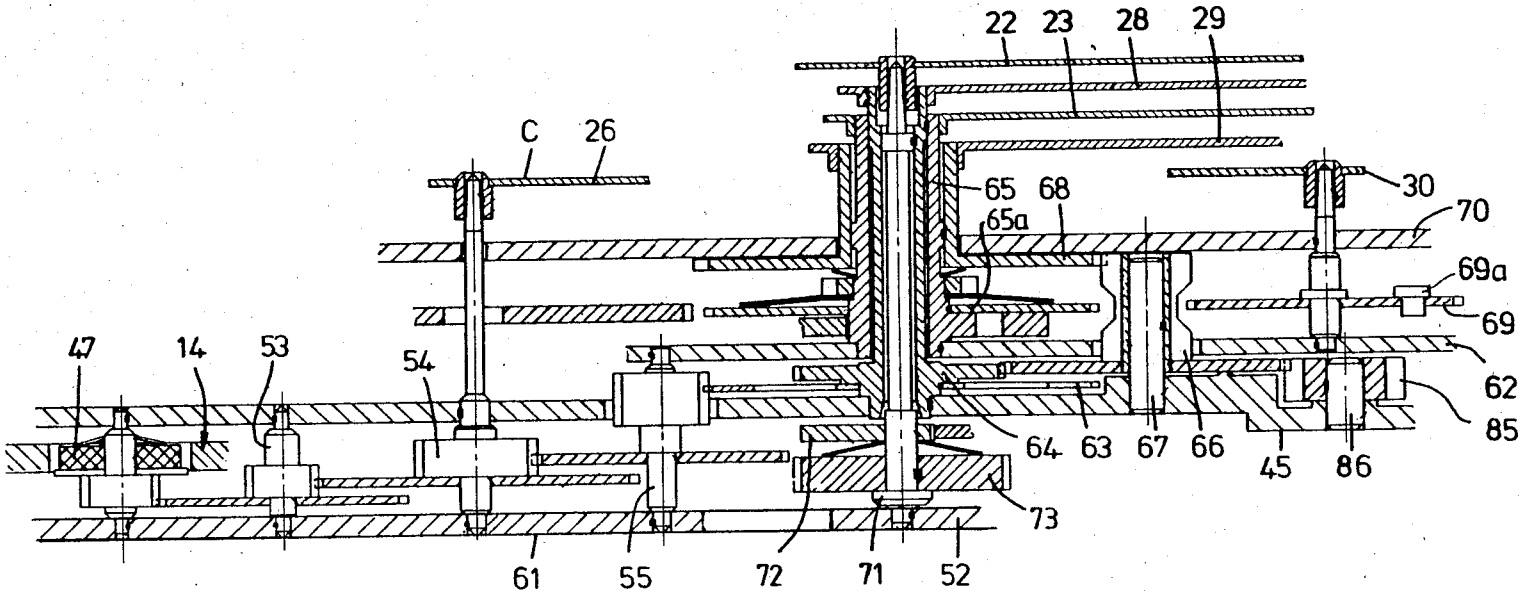
FIGS. 5, 6 and 7 are sections taken on the lines V—V, VI—VI, and VII—VII, respectively, of FIG. 4, showing the various elements of the wheel trains of the chronograph watch.

The rotor 47 of the second motor 14 drives a reduction train having three gears 53, 54, and 55, the second of which, 54, is an off-center fourth wheel, while the pinion of the third gear 55 engages a center wheel 63 bearing hand 28 (FIG. 5).

Also to be seen in FIG. 4 is a battery 56 constituting the power source of the watch. The capacity of battery 56 is sufficient to power the chronograph watch in question for some 18 to 30 months, depending upon how frequently the chronograph is used.

The control mechanism is shown in FIG. 4. A stem 57 bearing crown 31 is disposed radially in the movement and controls conventional setting lever 42, already shown in FIG. 3. Setting lever 42 cooperates with a setting-lever spring 58 blanked in one piece with yoke 44, which controls a clutch wheel 59 sliding on a square of stem 57. With this mechanism, the watch mechanism is set in a completely conventional manner. Stem 57 has three positions: a neutral innermost position, then an intermediate position in which a stud 60 of setting lever 42 enters a deep notch in yoke 44, and the latter moves toward the outside so that nose 43 is in contact with the blade of contact 18 (FIG. 3). This intermediate position is therefore a date-correction position, and successive pulses are then emitted by electronic circuit 16 in order to cause the date figure to advance, e.g., by one unit per second after a delay of a few seconds. In the outermost position of stem 57, stud 60 of setting lever 42 moves yoke 44 back toward the inside of the movement so that clutch wheel 59 engages a setting wheel 85 (FIG. 5). Hence the hands of the watch can be set normally by turning crown 31. In this setting position, nose 41 of setting lever 42 is in contact with the blade of contact 6. This switch therefore functions as a seconds-stop contact, causing motor 14 to stop. The holding torque of motor 14 suffices to lock the gears of the train during setting.

FIG. 4 also shows brakes acting upon various gears. These elements of the control mechanism will be discussed below.

Plate 45 is also shown in FIG. 5, as are chronograph bridge 52 and a wheel-train bridge 61. Further illustrated in this drawing figure are rotor 47 of motor 14, as well as the stator of this element, and the driving pinion meshing with the wheel of gear 53. Gear 54 comprises an elongated arbor which passes completely through the movement and bears small seconds-hand 26. Intermediate gear 55 pivots between bridge 61 and an intermediate bridge 62 placed on plate 45. The pinion of gear 55 engages center wheel 63 which is friction-mounted on a cannon pinion 64 pivoting both in plate 45 and inside the pipe of a gear 65, which bears minute-register hand 23. The friction between wheel 63 and cannon pinion 64 must be weaker than the holding torque of motor 14 so that hands 28 and 29 can be set without displacing hand 26.

Cannon pinion 64 drives a minute wheel 66 which pivots on a shaft 67 fixed in plate 45 and drives an hour wheel 68 coaxial with gear 65. The periphery of wheel 68 also meshes with an intermediate gear (not shown in FIG. 5) which actuates a gear 69 for indicating the hours up to 24 hours. Gear 69 pivots between intermediate bridge 62 and a mechanism cover 70; it bears a rotary contact element **69*a* which cooperates with a fixed element so as to constitute wheel 15 (FIG. 1**) designed to count the days.

Figure 6:
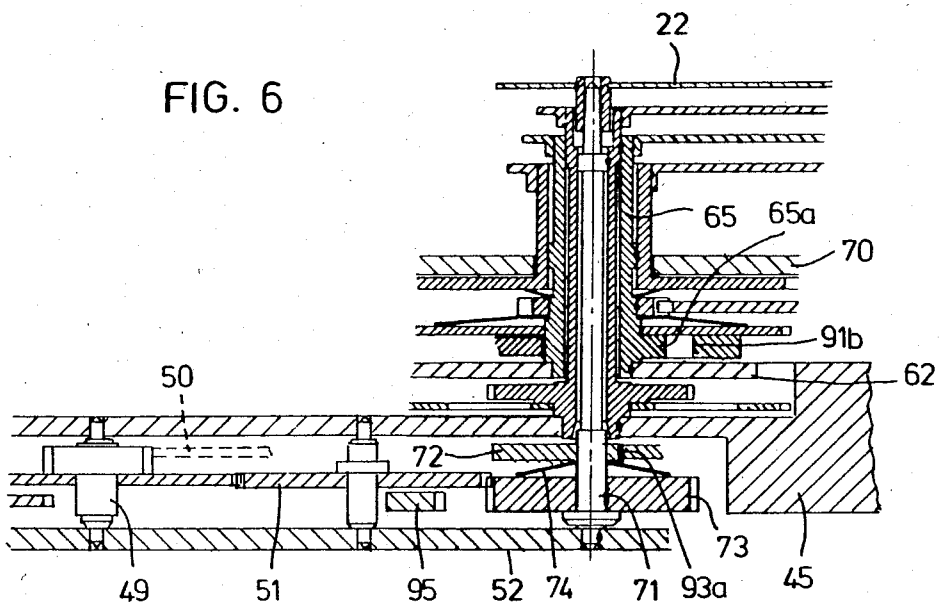
Figure 7:
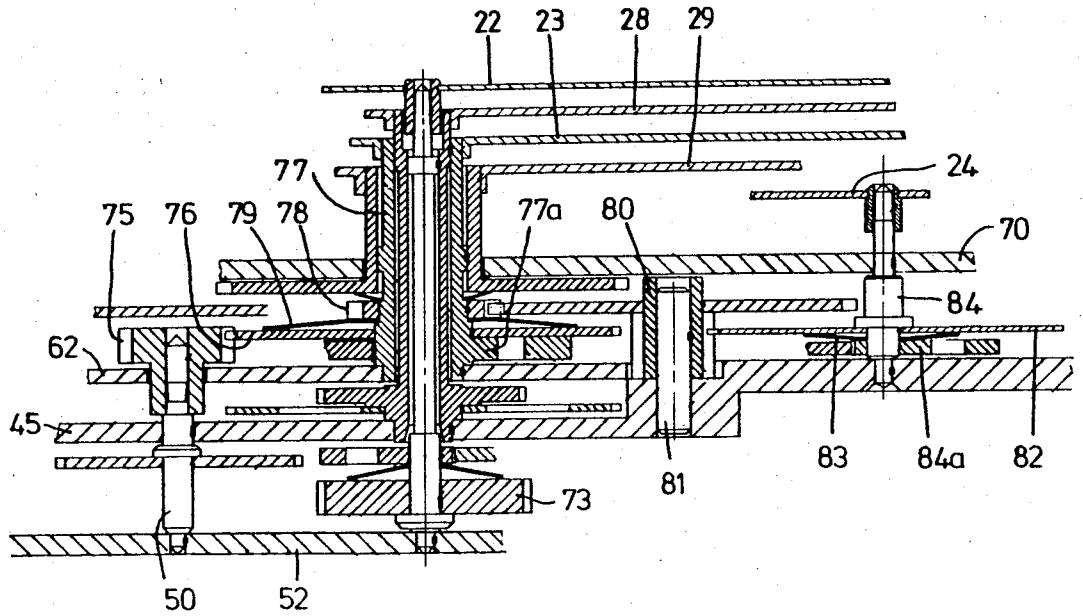

The most important elements of the chronograph mechanism are now shown in FIGS. 6 and 7. Again to be seen in FIG. 6 are plate 45, mechanism cover 70, intermediate bridge 62, and chronograph bridge 52. Motor 12 is not shown in this drawing figure, nor is gear 48. However, gear 49 and intermediate wheel 61 are illustrated, as well as the chronograph fourth wheel made up of an arbor 71 bearing a heart-piece 72 and, at the top, hand 22, and a drive pinion 73 friction-coupled to arbor 71 by a spring washer 74.

Also shown in FIG. 6 is the wheel of gear 50, likewise to be seen in FIG. 7. Gear 50 pivots between bridge 52 and plate 45. It bears a drive pinion 75, the teeth of which are situated above intermediate bridge 62 and mesh with a wheel 76 of the minute-register gear. This gear comprises an arbor 77, the lower part of which forms a heart-piece **77*a*, and a pinion 78 driven onto a cylindrical bearing surface situated above heart-piece 77*a*. A spring washer 79 biased between wheel 76 and pinion 78 constitutes a friction coupling between these two elements of the minute-register gear. This friction coupling and the one mounted on the fourth gear make it possible to reset the hands without the wheel train and the rotor of motor 12 being rotatingly driven. Moreover, locking brakes are also provided, as will be seen below, for keeping the gears of the chronograph train stationary when motor 12 is not running. These brakes are also intended to prevent backlash. Pinion 78 drives an intermediate minute wheel 80 mounted on a stud 81; the pinion of wheel 80 drives a wheel 82 friction-coupled by means of a leaf 83 to an arbor 84 bearing hour-register hand 24 situated at 6 o'clock on the dial. A heart-piece 84***a*, integral with arbor 84, cooperates with a hammer, as will be seen below, for resetting the hour-hand.

It will be noted that in FIG. 5, setting wheel 85 is mounted on a fixed pin 86.

Figure 8:
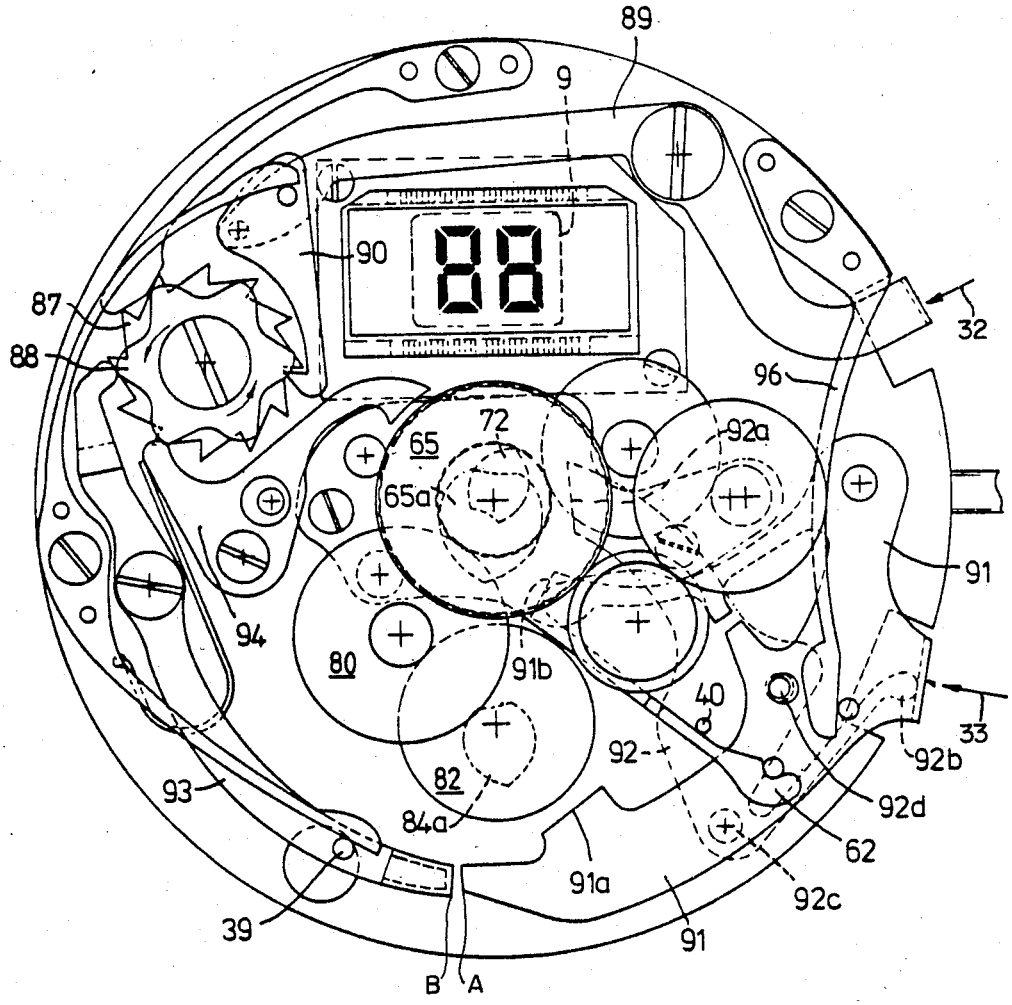
FIGS. 8 and 8A are top plan views of two embodiments of the watch with the dial and hands removed.

Whereas the watch wheel train shown in FIG. 5 operates in a conventional manner, the operation of the chronograph train depends upon a user control mechanism which is itself conventional to users of mechanical chronographs and is shown in FIG. 8. Generally speaking, this mechanism comprises a wolf-toothed wheel 87 with a cam 88, a starting and stopping lever 89 intended to be actuated by push button 32 and provided with a hinged hook 90, a hammer assembly 91, 92 actuated by push button 33, a locking lever 93 actuated by cam 88, and an assembly of two brakes 94, 95 (FIGS. 8 and 4) acting upon the wheel of minute-register gear 65 and upon pinion 73 of chronograph fourth gear 71, respectively.

As for hammers 91 and 92 (FIG. 8), they are hinged to one another and controlled by push button 33. Hammer 91 comprises a first active edge 91*a* which acts upon heart-piece 84*a* of gear 84 upon resetting, and a second active edge 91*b* which is situated on an arm of hammer 91 blanked so as to exhibit a certain elasticity relative to the rest of the part. Edge 91*b* cooperates with heart-piece 65*a* integral with gear 65. Finally, the second hammer 92 comprises an edge 92*a* which presses against heart-piece 72 to return gear 71 to its zero position upon the resetting movement controlled by push button 33.

A comparison of FIGS. 8 and 3 now makes it evident that stem 39, used to control the starting and stopping of chronograph motor 12, is integral with locking lever 93, while stem 40, controlling the resetting of the digital display, is integral with hammer 92.

The operation of the chronograph by a user is thus absolutely conventional. The position shown in FIG. 8 represents a running position. All the contacts are open, and all the brakes and hammers are spaced apart from the gears with which they cooperate. Pressing button 32 causes cam wheel 87 to rotate one step counterclockwise, as viewed in FIG. 8, so that the rear noses of levers 93 and 94, displaced by the pressure springs, pivot opposite a hollow of cam 88. Stem 39 grounds contact 7. Brake 94 comes to press against wheel 65, and brake 95, released by stem 39 (see FIG. 4), comes to press against pinion 73. The positions reached by the chronograph gears are therefore blocked in order that a reading may be taken, while the hundredths of a second can be read on device 9.

Subsequently, pressing button 33 first causes hammer 91 to rotate but also drives hammer 92, which pivots on pin 92*c*, and the resilient arm 92*b* of which is hooked to an edge of hammer 91. Heart-pieces 72, 65*a*, 84*a* of the three chronograph gears are thus reset by hammers 92*a*, 91*b*, 91*a*, while stem 40 causes the digital display to be reset by grounding contact 10.

When button 33 is released, spring 96 returns hammer 91 to its rest position, and pin 92*d* drives hammer 92, which resumes its rest position.

Pressing button 32 once more causes column wheel 87 again to advance one step, which returns lever 93 and 94 to the positions shown in FIG. 8. Stem 39 moves away from blade 7, causing chronograph motor 12 to restart.

In the embodiment being described, lever 93 and hammer 91 have the shapes illustrated in FIG. 8. This means that in the position shown in FIG. 8, push button 33 cannot be operated to actuate hammer 91 since lever 93 would block hammer 91 as long as it is in the position illustrated in that drawing Figure. That is, portion A of hammer 91 would interfere with portion B of lever 93 if push button 33 is operated to move the first active edge 91A of hammer 91 into engagement with heart piece 84A of gear 84.

Figure 8A:
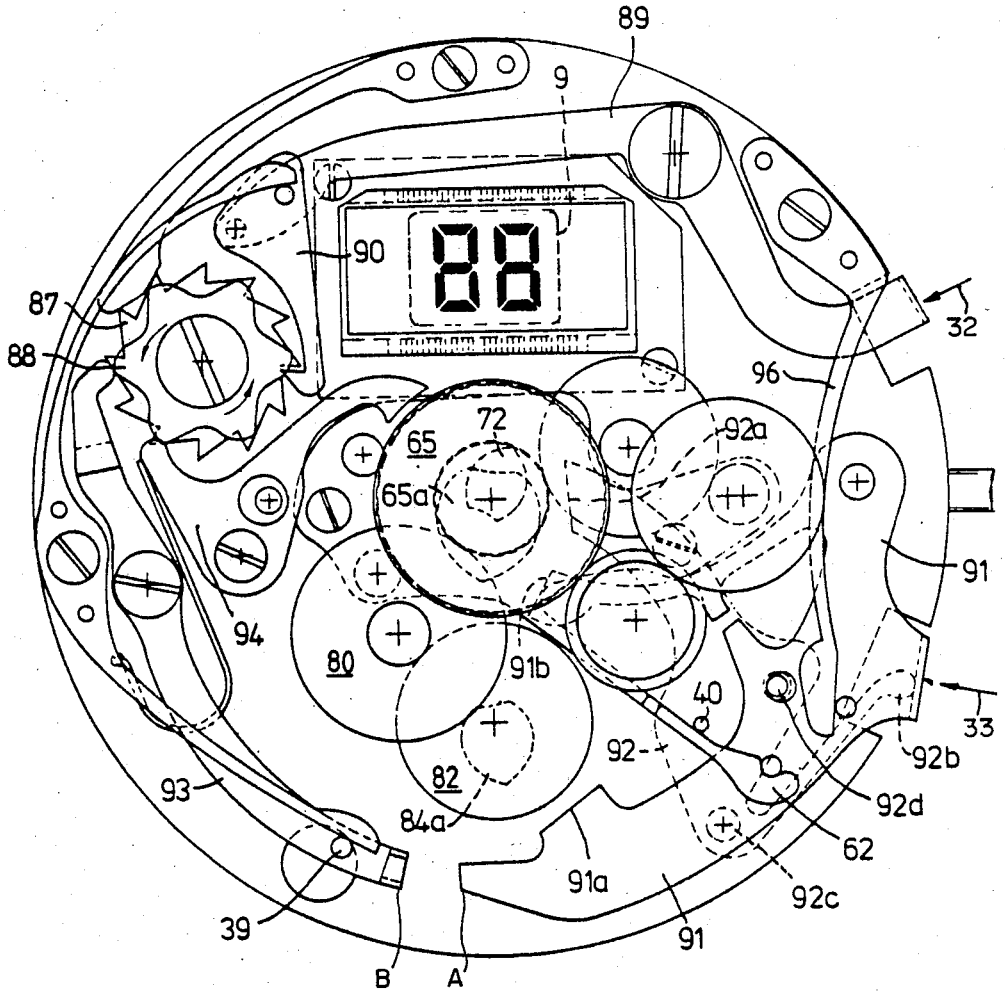

In order to produce a modified version in which reading at a glance would be possible, it would suffice to blank or slightly shorten lever 93 than is shown in FIG. 8. As illustrated in FIG. 8A, portion B of lever 93 is shortened to prevent interference between lever 93 and hammer 91 upon pressing a push button 33. This causes the chronograph gears and digital display device 9 to be reset without stopping chronograph motor 12. Counting resumes immediately after the return springs of the hammers have again retracted these parts from the counting gears. As stated earlier, provision can be made to have the digital display circuit retain for a few moments the hundredths-of-a-second indication displayed when button 33 is pressed, so that this indication can be read, whereupon the display returns to the indication of the normal count.

For carrying out the functions described above, the electronic circuit diagrammed in FIG. 1 comprises a certain number of arrangements and auxiliary elements, the most important of which will now be mentioned.

Since the power consumption of the timepiece described may vary greatly from one user to another, inasmuch as it depends upon how frequently the chronograph functions are used, it is extremely difficult to predict and indicate in advance the life of the battery. It will therefore be preferable to provide the electronic circuits with a system, known per se, for detecting the voltage of the battery and generating a signal when that voltage drops below a predetermined limit. For example, when a battery on the order of 1.5 V is used, the voltage limit may be fixed at 1.4 V. This signal is designated P in FIG. 1, where it is shown to be transmitted to a converter Pi connected to date counter 16. When the voltage of the battery drops below 1.4 V during normal service, i.e., when the chronograph is not running and digital display 9 shows the date, circuit Pi causes the date indication to flash.

This battery-voltage detector, or another detector of the same kind, can also be used to remedy a difficulty which may arise during operation of the devices described: although the duration of the pulses of the two stepping motors 12 and 14 is extremely short, which means substantially that it is less than 1/100 sec., it may happen, according to when the chronograph movement is started, that the battery must supply the power for actuating both motors at the same time. In order to prevent too great a voltage drop at the terminals of the battery, two steps may be provided for. Firstly, it should be ensured that the polarities of the pulses controlling the two motors are reversed. Secondly, the pulses shaped in circuits 13 and 11 should be controlled in such a way that in the event of simultaneous actuation, the pulse actually transmitted to chronograph motor 12 will be shifted, e.g., by a hundredth of a second, relative to the pulse supplied to motor 14. For practical purposes this shift is invisible, and its effect is to avoid an excessive drain on the battery.

Another important element is the voltage doubler circuit D.T. (FIG. 1) to which the signals of the 32 kc/s time standard are supplied. In a case where motors 12 and 14 are designed to operate at the voltage supplied by the batteries currently provided for timepiece movements, i.e., 1.5 V, it is known to be advantageous to feed an electro-optical display device, and most particularly a liquid crystal device, with a voltage higher than that of this battery; and by connecting a voltage doubler, for instance, at the input of the decoder, liquid crystal cells can easily be powered at a much more suitable voltage.

It would be equally possible, of course, to provide for a substitute solution consisting in designing the motors to operate at 3 V; all the circuitry would be powered at that voltage by a battery supplying double the voltage of the usual batteries.

The part played by brakes 94 and 95 in connection with the partially electronic and partially mechanical control of the functions of the chronograph should also be noted. In order to reduce the consumption of the battery, the motors—especially the chronograph motor—should be designed so that the holding torque is not too great. On the other hand, the chronograph motor should be prevented from rotating under the influence of the hammers actuating the heart-pieces when the mechanism is reset, for which reason friction couplings have been provided on all the gears having heart-pieces. When the chronograph hands are reset, pinion 73 of the sweep seconds-hand and wheel 76 actuating the minute-register hand are blocked by brakes 94 and 95. At the time of adjustment of pin 39 which, when the chronograph is stopped, controls both contact 7 and brake 95, provision can be made for contact 7 to be grounded a fraction of a second before or after the brake is released. Thus, in the event that the chronograph is stopped at the precise moment when a pulse is supplied to the motor, it is possible to keep the sweep seconds-hand from being blocked in an intermediate position between two of the seconds markings on the dial.

Finally, with regard to FIG. 1, the connection HS between control circuit C and the time standard must be mentioned. This connection makes it possible to render all functions of the watch inoperative when contact 6 is actuated by pulling out the crown into its outermost position. Owing to connection HS, finished watches can be stocked with the battery in place without running the risk of exhausting the battery by keeping the various circuits energized.

Although a watch mechanism has been described in which setting is performed by essentially mechanical means, it would be equally possible to provide in another embodiment for electronic setting of the hands and the watch mechanism, i.e., of hands 28, 29, and 26. In this case, instead of crown 31 and stem 57 acting upon setting lever 42 and yoke 44, they would control one or more contacts, upon either axial or rotary displacement, and these contacts would act upon the electronic circuit controlling motor 14. Date counter 16 could then be incorporated directly in counter 2, and it would no longer be necessary to provide rotary contact 15 for effecting the digital display of the date. If need be, counters 2 and 16 might be designed to produce a perpetual calendar, so that it would no longer be necessary to provide a date-correction mechanism.

It will be understood that the term electro-optical display device is intended here to designate any device by means of which time data can be displayed electrically without the movement of any material body, hence without delay due to inertia.

What is claimed is:

1. A chronograph-watch comprising:

a gear train formed of a plurality of rotating members in meshing engagement;

a set of rotating displaying parts attached to said plurality of rotating members of said gear train;

friction couplings between each one of said displaying parts and a corresponding one of said rotating members;

a step motor driving said gear train;

a time counting electronic circuit having an output connected to said motor;

a first switch connected to a first input of said counting circuit for starting and stopping said counting;

a second switch connected to a second input of said counting circuit for resetting said counting;

a start-and-stop mechanism provided with a first control pusher and a brake member, said brake member acting on said gear train for holding said gear train at rest, and said brake member and said first switch being controlled by said first pusher; and a return mechanism provided with a second control pusher and a set of hammer means for acting on said displaying parts, said hammer means and said second switch being controlled by said second pusher.

2. The chronograph-watch according to claim 1, wherein each displaying part of said set of displaying parts is coupled through a friction coupling with a different member of said plurality of rotating members, said displaying parts being driven at different relative speeds; and said brake member is a brake lever linked to said control pusher and arranged for acting on the rotating member of said gear train that is coupled to a displaying part rotating at a highest relative speed.

3. The chronograph-watch according to claim 2, wherein said start-and-stop mechanism comprises a rocking lever alternatively movable between two end positions in response to successive actuations of said first pusher, said brake lever being linked to said rocking lever and comprising a first arm with an edge portion intended to radially contact said rotating member having a highest relative speed and a second arm with an edge portion acting upon a rigid projection of said rocking lever, said brake lever being biased against said projection through a spring means.

4. The chronograph-watch according to claim 3, wherein said return mechanism comprises a hammer lever linked to said second control pusher, said hammer lever having a protruding portion; and wherein said rocking lever of said start-and-stop mechanism comprises a corresponding protruding portion, said protruding portions of said rocking lever and said hammer lever being shaped in such a manner that said rocking lever protruding portion locks said hammer lever against a return action when said rocking lever stands in one of said end positions corresponding to a running state of said chronograph-watch.

5. The chronograph-watch according to claim 1, wherein each one of said start-and-stop and return mechanisms comprises at least one rocking part linked to the corresponding pusher, each of said first and second switches comprises a fixed element and a movable element and each of said movable elements is integral with a rocking part of the corresponding mechanism in such a manner that the fixed element in each switch is grounded upon contact with the corresponding movable element, the contacting times being precisely controlled through rocking movements of said rocking parts.

6. The chronograph-watch according to claim 5, comprising a frame with a fixed substrate sheet held therein, said substrate supporting said electronic circuit and said fixed elements, the fixed elements being elastic blades connected to said inputs and said movable elements being rigid pins supported and grounded through the said rocking parts, both fixed and movable elements of said first switches being adjusting in such a manner so that the first switch turns slightly before said brake member acts upon said gear train in response to a stopping movement effected by said first pusher.

7. The chronograph-watch according to claim 5, wherein said hammer means comprises a main hammer and an auxiliary hammer lever, both of which pivot on fixed axes, said auxiliary hammer lever having a pin rigidly fixed thereto which forms a movable element of said second switch.

8. The chronograph-watch according to claim 7, wherein said set of rotating displaying parts comprises three time counting wheels for counting the hours, the minutes and the seconds respectively, the hours counting wheel being eccentric with respect to the minute and second counting wheels, said minute and second wheels being coaxial with the watch, and wherein said main hammer comprises two urging portions able to rotate the hour wheel and the minutes wheel respectively for returning them to a zero portion and the auxiliary hammer lever comprises an additional urging portion able to rotate the second wheel to a zero position.

9. The chronograph-watch according to claim 1, wherein said circuit comprises a further output connected to an electro-optical display means, first and second periodical signals being provided at each of said outputs respectively and the frequency of said second signal being a multiple of the frequency of said first signal.

10. The chronograph-watch according to claim 9, wherein the frequency of said first signal is 1 Hz and the frequency of said second signal is 100 Hz.

* * * * *